United States Patent [19]

Wickramasuriya

[11] Patent Number: 4,458,641

[45] Date of Patent: Jul. 10, 1984

[54] INTERNAL COMBUSTION ENGINE

[75] Inventor: Damasius B. I. Wickramasuriya, South Benfleet, England

[73] Assignee: Ford Motor Company, Dearborn, Mich.

[21] Appl. No.: 550,080

[22] Filed: Nov. 9, 1983

[30] Foreign Application Priority Data

Nov. 13, 1982 [GB] United Kingdom ..... 8232478

[51] Int. Cl.[3] ..... F02F 7/00; F02M 1/00

[52] U.S. Cl. ..... 123/195 A; 123/196 R; 123/198 C; 123/198 E; 123/90.38

[58] Field of Search ..... 123/90.41, 90.38, 195 R, 123/195 A, 196 R, 198 C, 198 E; 417/471, 259; 60/305

[56] References Cited

U.S. PATENT DOCUMENTS 3,359,721 12/1967 McIlroy ..... 123/90.38
3,359,722 12/1967 Sebestyen ..... 60/305
4,156,416 5/1979 Weisgerber et al. ..... 123/196 R

FOREIGN PATENT DOCUMENTS

WO81/01593 6/1981 PCT Int'l Appl. ..... 123/195 A

*Primary Examiner*—Ethel R. Cross
*Attorney, Agent, or Firm*—Robert E. McCollum; Clifford L. Sadler

[57] ABSTRACT

An internal combustion engine comprises a cylinder head (1), a camshaft (2) mounted thereon, a rocker cover (4) and a rotary vacuum pump (10) mounted on the cylinder head (1) within the rocker cover (4) and driven by the camshaft (2), providing compact packaging and low noise levels. The vacuum pump is lubricated from the camshaft via the pump exhaust port (30) discharging air into the rocker cover.

6 Claims, 3 Drawing Figures

INTERNAL COMBUSTION ENGINE

This invention relates to internal combustion engines, and more particularly to a vacuum pump driven by the engine.

In motor vehicle internal combustion engines having a cylinder head and a camshaft mounted thereon and enclosed by a rocker cover, it is often desirable to provide a rotary vacuum pump for supplying the vacuum needs and controlling the operation of the engine and ancillary equipment. The mounting of the pump on the engine may create difficulties in packaging the engine in the limited space available in the engine compartments of most motor vehicles. Additionally, the vacuum pump can generate undersirably high noise levels.

According to the present invention, there is provided an internal combustion engine comprising a cylinder head, a camshaft mounted on the cylinder head, a rocker cover mounted on the cylinder head and enclosing the camshaft, and a rotary vacuum pump mounted on the engine, characterized in that the vacuum pump is mounted on the cylinder head within the rocker cover, and driven from the camshaft.

By mounting the vacuum pump on the cylinder head within the rocker cover, the vacuum pump does not encroach into the limited space available adjacent the engine. Moreover, the rocker cover provides sound insulation for the vacuum pump.

Pumps mounted within the rocker cover are known. For example, U.S. Pat. Nos. 3,359,721 and 3,359,722 each show an air pump mounted on an engine within the rocker cover. However, the pumps are driven by the reciprocating motion of the rocker arm-valve stem, and not the camshaft, and the pump bearings are not lubricated by oil from the camshaft.

In this case, the oil within the rocker cover can facilitate lubrication of the vacuum pump. The vacuum pump exhaust port is positioned to receive lubricating oil from within the rocker cover. The oil may be supplied to the pump in the form of a spray by positioning the exhaust port adjacent a cam lobe on the camshaft. Alternatively, where the camshaft is hollow and contains lubricating oil, the exhaust port may be positioned opposite a hole in the camshaft from which a jet of oil emerges when the engine is in use.

The vacuum pump preferably is of the rotary vane type in which a stator is fixed to the cylinder head, a rotor is mounted in one or more bearings in the stator, and vanes extend generally radially from the rotor into engagement with the stator. Lubricating oil trapped between adjacent vanes of the rotor preferably passes along a lubricating passage between the rotor and the stator to the bearing or each bearing, as the case may be.

The inlet to the vacuum pump conveniently is provided by a hollow bolt which also secures the pump to the cylinder head.

A preferred embodiment of the invention will now be described, by way of example only, with reference to the accompanying drawings, in which.

Figure 1:
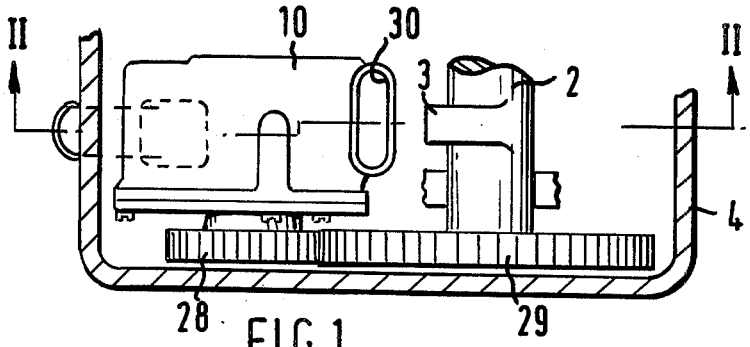
FIG. 1 is a plan view, partly in cross-section, of an engine constructed in accordance with the invention.
Figure 2:
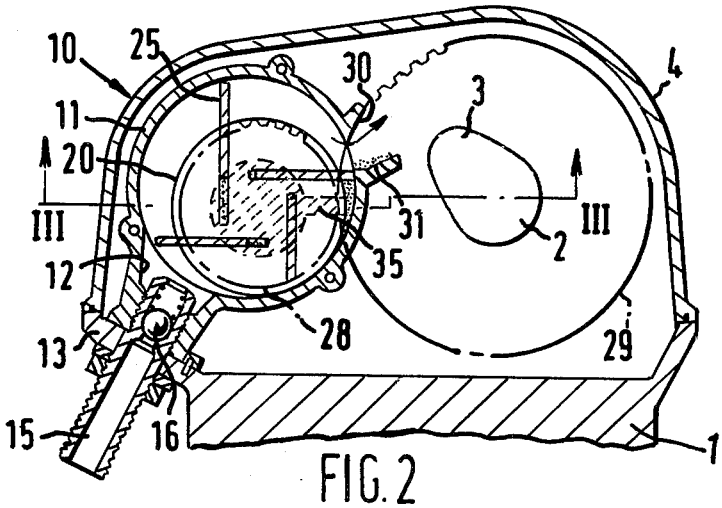
FIG. 2 is a cross-sectional view of the engine taken on a plane indicated by and viewed in the direction of arrows II—II of FIG. 1.

Referring to the drawings, an internal combustion engine comprises a cylinder head 1 on which is mounted a rotatable camshaft 2 provided with a plurality of cam lobes, one of which is illustrated at 3. The camshaft 2 is enclosed by a rocker cover 4 which is bolted to the cylinder head 1.

A vacuum pump 10 is mounted on a cylinder head 1 within rocker cover 4, and includes a stator 11 having an internally threaded air inlet part 12. The latter is secured to a mounting 13 of the cylinder head by means of a hollow bolt 15 which projects through a hole in the mounting 13 into inlet port 12. The hollow bolt 15 also incorporates an air inlet check valve 16.

A rotor 20 is eccentrically mounted within stator 11 by two bearings 21, 22 and carries a set of slidable vanes 25 which extend radially from the rotor into engagement with the stator. The rotor carries a drive gear 28 which meshes with a gear wheel 29 on camshaft 2. The gear ratio between drive gear 28 and gear wheel 29 is 2:1 so that rotor 20 is driven from camshaft 2 at the same speed as the engine crankshaft (not shown). If desired, the vacuum pump may be driven by a belt or chain.

The stator 11 has an exhaust port 30 which discharges air into the rocker cover and is positioned diametrically opposite one of the cam lobes 3 on camshaft 2. The lower surface of exhaust port 30 has a dished formation 31 which allows liquid oil from the cam lobe to collect in the exhaust port 30 when the vacuum pump is in use.

Figure 3:
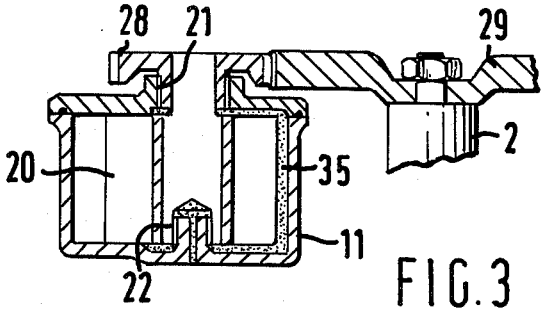
FIG. 3 is a cross-sectional view of the engine taken on a plane indicated by and viewed in the direction of the arrows III—III of FIG. 2.

In use, the rotor 20 is driven from camshaft 2 at engine speed, and movement of vanes 25 causes air to be drawn into the space between the stator and the rotor from inlet port 12 at a low pressure and to be discharged at exhaust port 30 at a higher pressure. As the camshaft 2 rotates, lubricating oil sprays from cam lobe 3 and collects in the dished formation 31 in exhaust port 30. The movement of the vanes 25 past the exhaust port then pushes the lubricating oil into the gap between stator 11 and rotor 20. As best seen in FIG. 3, the stator is shaped to provide a lubricating passage 35 between the rotor and the stator along which lubricating oil trapped between adjacent vanes 25 can pass to the bearings 21, 22.

The vacuum pump 10 is therefore conveniently packaged within the rocker cover, which provides sound insulation for the vacuum pump and facilitates lubrication.

I claim:

1. An internal combustion engine comprising a cylinder head having a camshaft mounted thereon, a rocker cover mounted on the cylinder head and enclosing the camshaft, and a rotary vacuum pump mounted on the engine, characterized in that the vacuum pump is mounted on the cylinder head within the rocker cover and driven from the camshaft.

2. An engine according to claim 1, wherein the vacuum pump includes an exhaust port positioned to receive lubricating oil therein from within the rocker cover.

3. An engine according to claim 2, wherein the exhaust port faces a cam lobe on the camshaft to receive lubricating oil sprayed therefrom.

4. An engine according to claim 2, wherein the camshaft is hollow and in use contains lubricating oil under pressure, and the exhaust port faces a hole in the camshaft through which a jet of lubricating oil can emerge.

5. An engine according to any of claims 1 to 4, comprising a stator fixed to the cylinder head, a rotor rotatably mounted in bearings in the stator, vanes extending generally radially from the rotor into engagement with the stator, and a lubricating passage between the stator and the rotor through which lubricating oil trapped between adjacent vanes and the rotor may pass to the bearings.

6. An engine according to any one of claims 1 to 3, wherein the pump is secured to the cylinder head by a hollow bolt which provides an air inlet to the pump.

* * * * *